United States Patent [19]

Waldbillig et al.

[11] 4,110,235

[45] Aug. 29, 1978

[54] ETHYLENE-HYDROCARBON COPOLYMERIC VISCOSITY IMPROVERS CONTAINING COLOR AND STABILITY IMPROVERS

[75] Inventors: James O. Waldbillig, Wappingers Falls; Carmen M. Cusano, Poughkeepsie, both of N.Y.; David D. Reed, Tokyo, Japan; Richard L. Winstead, Hopewell Junction, N.Y.

[73] Assignee: Texaco Inc., New York, N.Y.

[21] Appl. No.: 782,862

[22] Filed: Mar. 30, 1977

[51] Int. Cl.[2] ..... C10M 1/32; C10M 3/26; C10M 5/20; C10M 7/30

[52] U.S. Cl. ..... 252/51.5 R; 252/42.7; 252/59

[58] Field of Search ..... 252/51.5 R, 59, 42.7

[56] References Cited

U.S. PATENT DOCUMENTS

| | | | |
|---|---|---|---|
| 2,725,358 | 11/1955 | Kluge et al. | 252/42.7 |
| 3,368,972 | 2/1968 | Otto | 252/51.5 R |
| 3,429,812 | 2/1969 | Kivelevich et al. | 252/42.7 |
| 3,472,773 | 10/1969 | Holst et al. | 252/42.7 |
| 3,522,180 | 7/1970 | Sweeney et al. | 252/59 |
| 3,539,633 | 10/1970 | Piasek et al. | 252/42.7 X |
| 3,551,336 | 12/1970 | Jacobsson et al. | 252/59 |
| 3,598,738 | 8/1971 | Biswell et al. | 252/59 |
| 3,634,247 | 1/1972 | Dupus et al. | 252/59 |

*Primary Examiner*—Helen M. S. Sneed

*Attorney, Agent, or Firm*—Thomas H. Whaley; Carl G. Ries; Henry W. Archer

[57] ABSTRACT

The color and viscosity stability of copolymeric $\alpha$-olefin viscosity index improvers and of oils containing same are improved by the incorporation therein of minor amounts of N,N'-bis(2-hydroxy-5-alkylbenzyl)$\alpha$-$\Omega$-diaminoethane wherein the alkyl group is a $C_4$ to $C_{30}$ alkyl group and the basic metal salts thereof.

8 Claims, No Drawings

ETHYLENE-HYDROCARBON COPOLYMERIC VISCOSITY IMPROVERS CONTAINING COLOR AND STABILITY IMPROVERS

BACKGROUND OF THE INVENTION

Field of the Invention

This invention relates to improving the color and viscosity stability of copolymeric ethylene-α-olefin viscosity index improvers conventionally incorporated in mineral oil base lubricants.

Such lubricants when subjected to elevated temperatures in service have a tendency to become thin. To retard this tendency, it is common practise to add to the lubricants viscosity index improvers such as ethylene α-olefin copolymers.

One problem encountered with such VI improvers is their lack of thermal shear stability which is a measure of the reduction of their viscosity after prolonged storage at 180°–300° F in air. This type of storage also results in a darkened appearance. Such a color degradation is unacceptable from the point of view of consumer appeal.

These and other related problem have mitigated against wide acceptance of ethylene-based polymers as lubricant viscosity index improvers.

SUMMARY OF THE INVENTION

In its composition aspect, the present invention resides in a color and viscosity stabilizing additive for ethylene-propylene viscosity improvers consisting essentially of a compound of the group of an N,N′-bis(2-hydroxy-5-alkyl-benzyl)-α,Ω-diamino alkane or a basic metal salt thereof.

In one product aspect, this invention consists of an additive package for lubricating oils which package includes a copolymeric ethylene-α-olefin viscosity index improver and 0.005 to 5.0 weight percent, and preferably between 0.01 to 1.0 percent of an N,N′-bis(2-hydroxy-5-alkylbenzyl)-α-Ω-diamino alkane or a basic metal salt thereof.

In another aspect, the invention resides in an essentially color-free or haze free lubricating oil additive or composition comprising from 99 to 25 percent by weight of a lubricating oil; from 1 to 75 percent by weight of an ethylene-α-olefin copolymer, preferably from 5 to 30% of an ethylene-propylene copolymer and 0.005 to 5.0 weight percent and preferably 0.01 to 1.0 weight percent of an N,N′-bis(2-hydroxy-5-alkylbenzyl)-α-Ω-diamino alkane or basic metal salt thereof.

The lubricant oils used in the present invention are mineral or neutral oils derived from paraffinic or naphthenic base petroleum oil or the like. These oils have Saybolt Universal Seconds (S.U.S.) viscosities of about 60 to about 200 at 100° F and specific gravities of about 0.80 to 0.90.

Specifications of typical oils are given below:

| | Oil A | Oil B | Oil C | Oil D | Oil E |
|---|---|---|---|---|---|
| Spec. Grav. 60/60° F | 0.85 | 0.85–0.868 | 0.871–0.887 | 0.88 | |
| API Grav. | 34 | 31.5–33.5 | 28.0–31.0 | 29 | 25 |
| Vis 100° F SUS | 100 | 123–133 | 325–350 | 100 | 104 |
| Vis 210° F SUS | 39 | 41.5 | 53–55 | | |
| Pour Point° | 10° F | 0 | 10 | 25° F | 20° F |

The ethylene-α-olefin copolymers used in the invention are those previously used as viscosity index improvers such as those described in U.S. Pat. Nos. 3,522,180; 3,551,336 and 3,598,738; which patents also provide methods for their synthesis. Most suitable among such polymers are those disclosed in U.S. Pat. No. 3,522,180; which are copolymers of ethylene and propylene having a number average molecular weight between 10,000 and 50,000, a propylene content of 20 to 70 mole percent, (as measured by NMR), preferably 30 to 50 mole percent and a molecular weight distribution of less than about 4.

The N,N′-bis(2-hydroxy-5-alkylbenzyl)alpha-omega diamino alkanes and their salts which are useful in the practise of this invention are described in coassigned U.S. Pat. No. 2,725,358. Generically, such compounds can be represented by the formula:

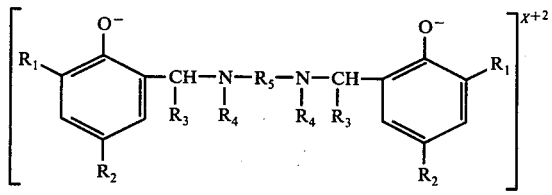

wherein $x$ is Ca, Ba, Mg or Zn, $R_1$ = H or $C_1$ to $C_2$ alkyl $R_2$ = $C_4$ to $C_{30}$ alkyl; preferably $C_5$–$C_{15}$ and branched chain alkyl.

$R_3$ or $R_4$ = H or $C_1$ to $C_3$ alkyl $R_5$ = $C_2$–$C_{12}$ alkylene (branched or straight chain) or $(CH_2—CH_2NH)_{1-3}$ $CH_2CH_2$—(polyethyleneamines).

The above compounds are obtained as set forth in the above mentioned patent by a condensation reaction between hydroxyaromatic compounds, amines and aldehydes. Typically, an alkylphenol-formaldehyde-ethylene-diamine condensation product prepared using 1:1.6:0.67 molar ratio of reactants; formaldehyde is added to a mixture of alkylphenol and ethylenediamine, the mixture is reacted at 175° F for 6 hrs, water is removed as the reaction mixture is heated to 290° F; the product is diluted with an equal weight of solvent neutral oil and polish-filtered by filtering using a filter aid such as diatomaceous earth.

The resulting condensation product is treated with NaOH to form the sodium salt. In turn, the other metal (X) salts are prepared metathetically by displacing the sodium.

The preparation of typical diaminoethanes is described in Examples 1–5 below.

EXAMPLE 1

N,N′-bis(2-hydroxy-5-alkylbenzyl)1,2-diaminoethane was synthesized by adding 1.6 m 36 percent aq. formaldehyde to a mixture of 0.67m 85 percent aq. ethylene diamine and 1.0m mixed alkylphenols while keeping the temperature below 175° F; stirring at 175° F for 6 hours; solvent stripping and heating to 290° F; diluting with an equal weight 100E Pale Oil and filtering. The product contained 3.0 percent N and had a OH number of 169 (Theory: 2,2 percent N and OH number of 88). The high nitrogen content is due to incorporation of the excess ethylenediamine into the molecule and the found OH number is twice theory since both OH and NH groups are titrated in the OH number determination.

EXAMPLE 2

The calcium salt of a similar compound as prepared in Example I was synthesized metathetically from that compound by heating a mixture of 1.25 mole of the compound, 49 g of the lubricating oil, 100 ml isoheptane, and 2.75m NaOH to 350° F while azeotroping out water; after stirring at 350° F for 1 hour, the mixture was cooled to 250° F; 1000ml methyl Cellosolve and 1.375m granular $CaXl_2$ was added and the mixture was refluxed for 3 hours. Solvent was stripped and the temperature was raised at 350° F. After stirring at 350° F for 3 hours the product was filtered. It contained 3.0 percent Ca, 2.4 percent N and had a total base number (TBN) of 124.9 (Theory: 2.83 percent Ca, 1.98 percent N, and TBN of 140).

EXAMPLE 3

The barium salt of the type of compound described in Example 1 was prepared by forming a mixture of 0.25 m of the compound, 34 g of lubricating oil, 150 ml methanol, and 0.30 m BaO to 350° F as solvent was removed. After stirring at 350° F for 3 hours, the product was filtered. It contained 9.8 percent Ba, 2.3 percent N, and had a TBN of 149 (Theory: 8.5 percent Ba, 1.76 percent N, and TBN of 142).

EXAMPLE 4

The magnesium salt of a similar compound as synthesized in Example 1 was prepared by reacting 240 grams thereof in the form of a solution in 650 grams of 300 SAE grade lubricating oil (diluted with toluene) with 510 milliliters (0.5 mole) of magnesium methylate in methanol solution. After the reaction was completed the solvent was stripped off under reduced pressure, and 894 grams of an oil solution containing 244 grams of reaction product were recovered. Additional lubricating oil was added to form a 25 percent concentrate of the reaction product. This solution analyzed 2.11 percent of ash (MgO) and 1.25 percent nitrogen.

EXAMPLE 5

The zinc salt of the compound of Example 1 was prepared by reacting 1.0 m thereof with 1.1 m $ZnCO_3$ and 1.1 m $H_2O$. The product contained 2.5 percent N, 5.2 percent Zn and had a TBN of 125 (Theory: 1.9 percent N, 4.5 percent Zn and TBN of 155.

Table 1 below shows the color, clarity and viscosity stability of a lubricating additive composition containing 13 percent by weight of an ethylenepropylene copolymer (number average molecular weight of about 25,000; propylene content of about 45 mole percent) and containing 87 percent by weight of Oil D (sp. gr. 0.88; API Gravity 29; Viscosity at 100° F, 100 SUS) to which has been added 0.05 weight percent of the calcium salt of the alkylphenol-formaldehyde-ethylenediamine condensation product (Example 2). For purposes of comparison, the uninhibited additive composition is also shown in Table 1.

TABLE I

| Tests | Inhibited Additive | Additive Containing No Inhibitor |
|---|---|---|
| Original | | |
| ASTM Color | L3.0 | L3.0 |
| Lumetron Turbidity | 7.5 | 8.0 |

TABLE I-continued

| Tests | Inhibited Additive | Additive Containing No Inhibitor |
|---|---|---|
| 210° F Furol Vis., SFS | 516 | 575 |
| 100° F Vis., SUS[1] | 364 | 363 |
| 210° F Vis., SUS[1] | 64.2 | 64.2 |
| After PVST[2] | | |
| ASTM Color | L6.0 | L4.5 (dil.) |
| Lumetron Turbidity | 14.0 | 54 |
| 210° F Furol Vis., SFS | 489 | 427 |
| 100° F Vis., SUS[1] | 355 | 341 |
| 210° F Vis., SUS[1] | 63.6 | 59.7 |
| After Storage (200° F/1 mo. in air | | |
| ASTM Color | L4.0 | L6.5 |
| Lumetron Turbidity | 11.0 | 30 |
| 100° F Vis., SUS[1] | 363 | 360 |
| 210° F Vis., SUS[1] | 64.5 | 64.0 |

[1]Blended at 11.5 wt. % in solvent neutral oil containing 0.5 wt. % of a mixture of 33% of copolymer of lauryl and stearyl methacrylate in 67% mineral oil (sp. gr. 0.86; vis SUS 100 145)

[2]Polymer Viscosity Stability Test (300° F/72 Hours in air).

As shown by the data in Table I, the color, clarity and viscosity stability of the inhibited composition are superior to those of the uninhibited composition on the basis of the Polymer viscosity stability Test (PVST) carried out by exposure of the compositions to 300° F for 72 hours and after storage at 200° F for 1 month in air.

Table II below compares the performance of the calcium salt of Example 2 with that of the dihydroxy compound of Example I. The products of both Example I and Example 2 were effective inhibitors for this batch of ethylene-propylene VI improver. The calcium salt of Example 2 was a more effective stabilizer than the parent dihydroxy compound of Example 1 on the basis of the results shown in PVST in Table II.

TABLE II

| Inhibitor Added* Test | 0.05 wt.% Ca Salt of Example 2 | 0.05 wt % Dihydroxy Compound of Example 1 | None |
|---|---|---|---|
| Original | | | |
| ASTM Color | L1.5 | L1.5 | L1.0 |
| Lumetron Turbidity | 8.0 | 8.5 | 6.5 |
| 210° F Furol, SFS | 565 | 655 | 565 |
| 100° F Blended Vis., SUS[1] | 364 | 366 | 356 |
| 210° F Blended Vis., SUS[1] | 65.8 | 66.0 | 65.7 |
| After PVST | | | |
| ASTM Color | L5.0 | L7.5 | L8.0 |
| Lumetron Turbidity | 32.0 | 44.0 | 28.0 |
| 210° F Furol, SFS | 634 | 509 | 424 |
| 100° F Blended Vis., SUS[1] | 361 | 357 | 342 |
| 210° F Blended Vis., SUS[1] | 65.5 | 64.7 | 63.7 |
| After 200° F (1 mo. in air) | | | |
| ASTM Color | L1.5 | L1.5 | L4.5 |
| Lumetron Turbidity | 8.0 | 11.0 | 62.0 |
| 100° F Blended Vis., SUS[1] | 368 | 363 | 361 |
| 210° F Blended Vis., SUS[1] | 66.2 | 66.0 | 65.3 |

[1]11.5 wt. % in solvent neutral oil containing 0.5 wt. % of a mixture of 33% of copolymer of lauryl and stearyl methacrylate in 67% turbine oil (sp. gr. 0.86 vis SUS 100 145)

*The batch of VI improver used in each of these three cases contained 13 wt. % ethylene-propylene copolymer and 0.02 wt. % of a phenolic antioxidant in a solvent neutral oil (Oil A).

To the lubricating oil compositions containing the additives of the invention, other usual additive materials such as dispersants, anti-wear agents, detergents, oxidation inhibitors, and the like, may be added to improve these characteristics.

The invention has been described in detail with particular reference to preferred embodiments thereof, but it will be understood that variations and modifications therein can be effected within the spirit and scope of the invention as described hereinabove and as defined in the appended claims.

What is claimed is:

1. A color and viscosity stabilized, viscosity index improving additive package for a lubricating oil comprising a copolymeric ethylene-α-olefin viscosity index improver and from 0.005 to 5.0 weight percent of a stabilizer consisting of at least one compound of the group of N,N'-bis(2-hydroxy-5-alkylbenzyl)α,Ω-diaminoethane wherein said alkyl group contains from 4 to 30 carbon atoms and the calcium, barium, magnesium and zinc salts thereof.

2. The composition according to claim 1, wherein the amount of stabilizer ranges from 0.01 to 1.0 weight percent.

3. An essentially haze free and color free lubricating composition containing from 99 to 25 percent by weight of a mineral oil; 1.0 to 75.0 percent by weight of an ethylene-α-olefin copolymer and from 0.005 to 5.0 weight percent of at least one color and viscosity stabilizer of the group of N,N-1-bis(2-hydroxy-5-alkylbenzyl)-α-Ωdiaminoethane and the calcium, barium, magnesium and zinc salts thereof.

4. The composition of claim 3, wherein the concentration of ethylene-α-olefin copolymer ranges from about 5 to about 30 weight percent.

5. The composition of claim 3, wherein said mineral oil has a Saybolt Universal Seconds viscosity of about 60 to about 200 at 100° F and a specific gravity of about 0.80 to 0.90.

6. The composition of claim 3, wherein the amount of said stabilizer ranges from 0.01 to 1.0 weight percent.

7. The composition of claim 3, wherein said copolymer is a copolymer of ethylene and propylene having a number average molecular weight between 10,000 and 50,000, a propylene content of 20 to 70 mole percent and a molecular weight distribution of less than about 4.

8. The composition of claim 3 containing a lubricating mineral oil having a Saybolt Universal Second viscosity of about 60 to about 500 at 100° F. and from 0.01 to 1.0 weight percent of the calcium salt of said diaminoethane.

* * * * *